United States Patent [19]

Zehr

[11] Patent Number: 4,553,758

[45] Date of Patent: Nov. 19, 1985

[54] SKIPPING STONES AND METHOD OF USE THEREOF

[76] Inventor: John S. Zehr, 5118 Marine View Dr. NE., Tacoma, Wash. 98422

[21] Appl. No.: 736,451

[22] Filed: May 21, 1985

[51] Int. Cl.[4] ..... A63B 67/06; A63B 65/10

[52] U.S. Cl. ..... 273/424

[58] Field of Search ..... 273/424, 425

[56] References Cited

U.S. PATENT DOCUMENTS

| | | | |
|---|---|---|---|
| 3,544,113 | 12/1970 | Hand | 273/424 |
| 4,212,462 | 7/1980 | Glovak et al. | 273/424 |
| 4,395,046 | 7/1983 | Cosmopulos | 273/424 |
| 4,463,954 | 8/1984 | Panse et al. | 273/424 |

FOREIGN PATENT DOCUMENTS

| | | | |
|---|---|---|---|
| 181801 | 4/1955 | Austria | 273/424 |
| 120012 | 5/1927 | Switzerland | 273/424 |

*Primary Examiner*—Paul E. Shapiro

*Attorney, Agent, or Firm*—Graybeal & Cullom

[57] ABSTRACT

Skipping stones having characteristics enhancing their ability to skip a large number of times on the surface of a body of water and enhancing the distance they will travel across the water before sinking. The stones are formed of somewhat porous, cementitious material and have a lower, generally circular water engaging surface which is slightly dimpled in its near-center region and slightly convex in its near-edge region with a sharply convex peripheral edge and a generally cylindrical, slightly upwardly converging side wall, the configuration of the peripheral edge of the water engaging surface and the adjoining sidewall being such as to minimize surface tension induced suction on the stone, caused by the water across which the water engaging surface of the stone is moving. The upper surface of the stone is generally flat so as to readily distinguish it from its lower, water engaging surface. The stone suitably comprises a cast mixture of gypsum cement and fine sand in approximately equal parts by volume. For a stone of a given radius dimension R (with R suitably $\frac{7}{8}''$, for example), the average thickness is about 0.4 R, the depth of the dimple in the near-center region of the stone water engaging surface is about 0.04 R, the reduction in thickness in the convex near-edge region thereof at the peripheral edge is about 0.1 R, and the angle of convergence of the sidewall is about 5°.

11 Claims, 4 Drawing Figures

SKIPPING STONES AND METHOD OF USE THEREOF

FIELD OF THE INVENTION

The present invention relates to disc structures and more particularly to skipping stones having characteristics enhancing their ability to skip a large number of times and enhancing the distance they travel across the surface of a body of water across which they are thrown, and to methods of fabrication and use of such stones.

BACKGROUND OF THE INVENTION

Skipping of stones and other objects across the surface of a body of water has long been a recreational pastime and customarily involves use simply of naturally occurring more or less flat stones found at random on a beach or ground near a body of water across which the stones are skipped.

Fabricated skipping stones are also known such as in Hand U.S. Pat. No. 3,544,113, which discloses what are termed disc assembly members of hard or soft rubber or plastic and which have various configurations, such as convex on both sides, convex on one side and flat on the other side, and convex on one side and concave on the other, and which have varying buoyancy characteristics so as to float, or sink, or sink slowly. Edge placed cushioning rings are also provided in certain forms.

Also known are so called pitching discs as disclosed in Palovik U.S. Pat. No. 3,201,128, for use in competitive tossing or pitching games in the nature of horseshoes or quoits, which pitching discs are suitably fabricated in a flexible, solid rubber with one flat or slightly convex side and one concave side, the concave or hollowed out side having a thin smooth lip or ring around the disc periphery. In use such discs are said to tend to slide forward if thrown with the flatter convex side down and, when thrown with the hollower concave side down, the disc will slide forward very little if any distance at all and if the target surface is quite smooth the disc may be made to adhere to the supporting surface with a slight vacuum, created by a downward initially flexing of the disc center when the peripheral lip or ring strikes the target surface, followed by an upward rebound toward the unflexed position. If desired, weight may be added near the center of such discs to increase their inertia and vacuum adhesion characteristics.

Also known and of general interest is what is termed a tip-cat as shown in Nagler U.S. Design Patent 29,553, the specific use of which is not disclosed, but which is a non-circular body of generally rectangular cross section in its center portion and with tapered, pointed ends, the central portion of the body having generally concavical top, bottom and side surfaces. It would appear such an article is fabricated of rubber and is used in the play of a game called tip-cat wherein it is struck by a bat by one player and caught or retrieved by other players.

SUMMARY OF THE INVENTION

Objects of the present invention include, and skipping stones according to the present invention have several unique features and advantages, including the realization of:

(a) a reproducible cast skipping stone having a slightly concave portion or dimple in its central region on its primary water contacting surface and a slightly convex outer region on such surface, the function of the dimple being to improve lateral stability, to minimize capillary attraction of the water to the stone, and to create a forward wake or spray on which the stone tends to ride as it travels across the surface of the water.

(b) a skipping stone with an angle on the edge of the primary water contacting surface of the stone that is beveled away from the water slightly which the configuration in combination with the tightly convex peripheral edge reduces the surface tension effect of the water at such edge, which surface tension would otherwise tend to slow the movement of the stone across the surface of the water ( or suction), enabling the stone to travel a longer distance across the water, (c) a reproducible cast skipping stone fabricated of a cementitious material which has a substantial surface and internal porosity, such porosity enabling the stone to take on a certain amount of water if soaked more or less briefly in water before it is thrown, which water content of the stone as thrown with a spinning motion then provides a water-to-water contact of the stone's primary water engaging surface with the surface of the water on which it is skipped, such water-to-water contact enhancing the distance across the water which the stone travels, and (d) a reproducible cast skipping stone fabricated of cementitious material which, though somewhat porous as indicated above, is sufficiently strong and durable to resist breakage in normal handling, and is easily and economically fabricated in simple cup-like molds.

These and other objects, features and advantages will be apparent to those skilled in the art to which the invention is addressed, taking into consideration the accompanying drawing and the following specific description of certain preferred embodiments of such skipping stones.

DESCRIPTION OF THE PREFERRED EMBODIMENTS

Figure 1:
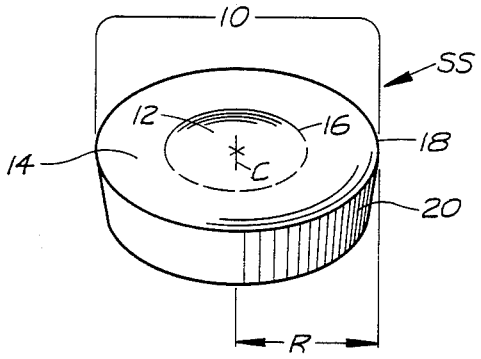
FIG. 1 is an isometric view taken from a lower aspect showing the bottom and part of the side of a typical skipping stone embodying the present invention.

FIG. 1 is an isometric view taken from a lower aspect of a skipping stone, generally indicated at SS, embodying the present invention, wherein the primary water engaging surface 10 comprises a dimpled near-center region 12 bounded by a slightly convex near-edge region 14, the boundary or transition therebetween being indicated at 16. Near-center region 12 extends from the center C outwardly about 45% of the radius R of the stone SS and the near edge region 14 thereof occupies the remaining portion of the primary water engaging surface 10, i.e. the region from boundary 16 outwardly to peripheral edge 18. The specific surface geometry of surface 10 of the stone SS is discussed in more detail below in connection with enlarged profile thereof shown in FIG. 4.

Figure 3:
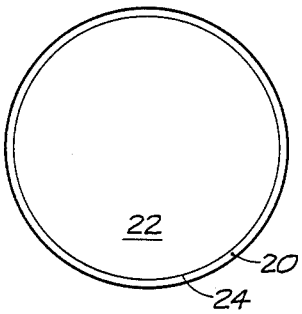
FIG. 3 is a top plan view of the skipping stone shown in FIG. 1.

The generally slightly convex near-edge region 14 of surface 10 has a progressively reduced thickness dimension and increasing slope outwardly away from the center C of stone SS and peripheral edge 18 is sharply convex. The side 20 of the stone SS is generally cylindrical in nature and occupies a cone of revolution about the axis of revolution (center C) of the water engaging surface 10 which converges upwardly toward such axis of revolution at a small angle, preferably about 5° (note FIG. 4), such side 20 in turn joining the upper surface 22 (FIG. 3) of the stone SS at a relatively sharp peripheral edge 24, which is formed in the course of casting of the stone as hereinafter discussed and which is of no functional significance in terms of the hydrodynamic characteristics of the stone in use except for the fact that the upper surface 22 of the stone, by reason of the casting procedure, is generally flat with a relatively sharp edge 24 and thus may be readily distinguished by the user from the lower, primary water engaging surface 10. Also, the upper surface 22 may be embossed or the like to carry a trademark designation or the like.

Figure 2:
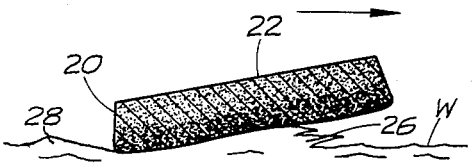
FIG. 2 is a diametric cross sectional view of the skipping stone shown in FIG. 1, and showing schematically the nature of the action of the stone as it contacts the surface of a body of water across which is skipping.

FIG. 2 illustrates by cross-sectional view the interior nature of the stone SS, the intent in the cross-sectional showing of the stone SS being to show that the water engaging bottom surface 10 and adjacent interior portion of the stone is relatively porous in comparison with the remaining portions of the stone by reason of the presence of a somewhat greater proportion of sand. FIG. 2 also is intended to show the action of the stone water engaging surface 10 as it moves across the water W in that the dimpled near-center portion 12 of the stone SS generates a slight forwardly directed wake 26 on which the stone rides, and the sharply convex peripheral edge 18 and converging side 20 of the stone effectively minimize surface tension action of the water W on the stone in the trailing portion of such edge 18, i.e. the formation of a minimal trailing wake 28.

To provide optimal hydrodynamic characteristics in the stone as well as enable economical fabrication thereof, the preferred method of making such stones is in rubber molds, suitably providing 100 cavities in a given mold. With ten such 100 cavity molds available for example, a casting mix is prepared by using a twelve ounce measuring receptacle and mixing six such measures of gypsum cement (Hydrostone gypsum cement, available from United States Gypsum Company being typically suitable), with six measures of fine sand (suitably 0 grade) and four measures of water, along with a few drops of wetting agent such as "Basic H", a linear alcohol alkoxylate surfactant. The mix is poured into each of the mold cavities and the stones are cast top side up. As soon as the mix is placed in the cavities, the molds are placed on a vibrating table and vibrated for 30–60 seconds to remove bubbles and to promote movement of the heavier particles (sand) toward the bottoms of the cavities, and thus improve the porosity of the water engaging surfaces and adjacent portions of the final cast stones. After subjecting the molds to the vibrating table action, the cast stones are suitably dried, as in an oven, at a temperature of from 150°–200° F. for about 1½ hours. After cooling the stones are then removed from the mold cavities and suitably packaged, as by being stacked coaxially in tubes.

To slightly increase the weight of the stones of a given size, finely ground copper slag or the like can replace all or part of the gypsum cement.

Figure 4:
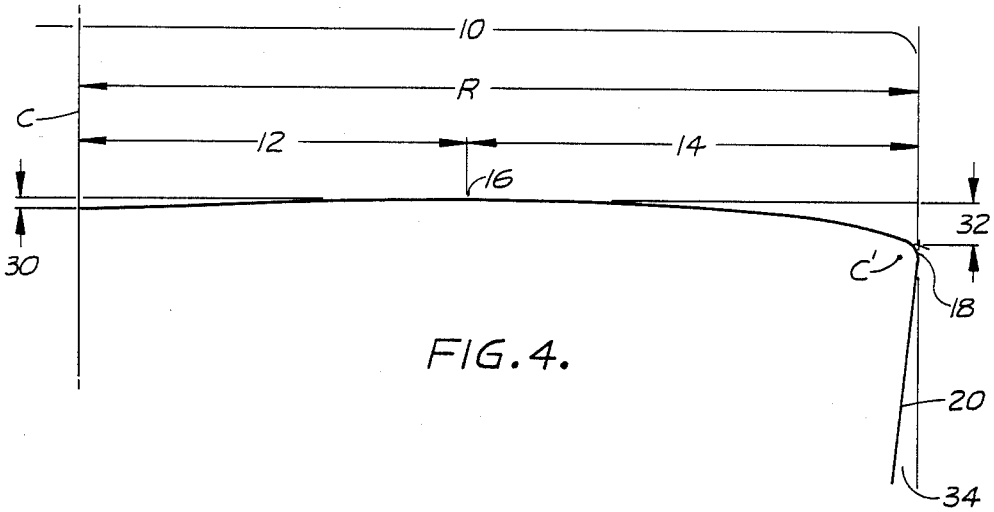
FIG. 4 is an enlarged schematic showing of the outline or profile of the skipping stone shown in FIGS. 1–3, showing further detail as to the surface configuration thereof.

FIG. 4 is an enlarged profile view schematically showing in further detail the contour of the primary water contacting surface 10 along a radius thereof and along the profile of the side 20. As shown in FIG. 4, the dimpled, near-center region 12 of the surface 10 drops from a high point at boundary 16 to the center C a distance 30 equal to about 4% of the radius R, the span of the near-center region 12 being about 45% of the radius R. The near-edge region 14 of the surface 10 is, as shown in FIG. 4, generally convex, dropping away from the boundary 16 to the peripheral edge 18 a distance 32 equal to about 10% of the radius dimension, with the curvature of the surface 10 at the peripheral edge 18 being about a radius of curvature centered at C' and equal to about 8% of the radius R. The side 20 of the stone, as shown in FIG. 4, is generally cylindrical in nature and occupies a cone of revolution about the axis of revolution of the stone (center C projected) which converges toward such axis of revolution at an angle of about 5°, as indicated at 34. The average thickness of the stone is suitably about 40% of the radius R. As a typical example, a stone SS configured in accordance with the present invention has a radius R of about ⅞th inch and the other dimensions thereof are proportionately related to such radius as indicated. As will be apparent, the radius of the stone can be varied subtantially as desired.

Concerning the manner of use of skipping stones according to the present invention, the substantial porosity of the stones imparted by the concentration of sand content at and adjacent the primary water contacting surface 10 (FIG. 2) gives the stone the capability of taking on a substantial amount of water if the stone is soaked in water a short time before use. When this is done, and when the water soaked stone is thrown in a flat trajectory with a spinning action across a body of water, the water emerging from the stone by reason of such spinning action provides an enhanced water-to-water contact of the stone with the surface of the body of water and thereby reduces the frictional drag of the stone on the water during such contact which in turn enhances the distance the stone can travel across the water before sinking. The slight degree of surface roughness imparted to the primary water engaging surface of the stone by virtue of its sand content also is considered as enhancing its ability to move across the surface of the water with minimal friction, it being notable in this regard that, as has been observed with respect to water skis, a slightly rough water-engaging surface, as can be developed by slightly sanding the water engaging surface of a water ski, performs better in the movement thereof across the water surface than does a smooth hard or waxed surface.

From the foregoing, various further modifications, adaptations, and applications of skipping stones configured and used in accordance with the present invention will occur to those skilled in the art to which the invention is addressed, within the scope of the following claims.

What is claimed is:

1. A skipping stone having characteristics enhancing its ability to skip a large number of times on the surface of a body of water across which it is thrown and enhancing the distance it will travel across the water before sinking, said skipping stone comprising;

a cementitious body having a lower, generally circular water engaging surface which is centrally dimpled in its near-center region and progressively outwardly convex in its near-edge region;

such water engaging surface being bounded by a sharply convex peripheral edge and a generally cylindrical side wall, the configuration of the sharply convex peripheral edge of the water engaging surface and the adjoining sidewall being such, as to minimize surface tension induced suction on the stone, caused by the water across which the water engaging surface of the stone is moving.

2. A skipping stone according to claim 1, wherein the stone is fabricated of a mixture of gypsum cement and fine sand in approximately equal parts by volume, with a greater concentration of sand near the lower, water engaging surface thereof.

3. A skipping stone according to claim 2, wherein the near-center region of the stone water engaging surface extends from the center thereof outwardly about 45% of the radius of the stone.

4. A skipping stone according to claim 1, wherein the stone is a cementitious mixture, the radius of the stone is a given dimensional unit, the maximum thickness is about 0.4 such unit, the depth of the concavity of the near-center region of the stone water engaging surface is about 0.02 such unit, the reduction in thickness in the convex near-edge region thereof at the peripheral edge is about 0.04 such unit, and the angle of convergence of the sidewall is about 5°.

5. A skipping stone according to claim 4, wherein the near-center region of the stone water engaging surface extends from the center thereof outwardly about 45% of the radius of the stone.

6. A skipping stone according to claim 1, wherein the upper surface of the stone is generally flat and joins the side of the stone at a relatively sharp peripheral edge.

7. The method of use of a skipping stone as set forth in claim 1, comprising:

soaking the stone in water for a time sufficient for the stone to absorb a substantial amount of water, and throwing the water soaked stone in a flat trajectory and with a spinning action across a body of water so that it will skip repeatedly on the water, the water emerging from the stone by reason of such spinning action providing an enhanced water-to-water contact of the stone with the surface of the body of water, thereby reducing frictional drag during such contact and enhancing the distance the stone travels across the water before sinking.

8. A skipping stone having characteristics enhancing its ability to skip a large number of times on the surface of a body of water across which it is thrown and enhancing the distance it will travel across the water before sinking, said skipping stone comprising:

a cast body of cementitious material having sufficient porosity to absorb water, said cast body having a lower, generally circular water engaging surface which is slightly dimpled in its near-center region and slightly convex in its near-edge region;

such water engaging surface being bounded by a sharply convex peripheral edge and a generally cylindrical side wall lying in a cone of revolution about the axis of revolution of the water engaging surface which converges upwardly toward such axis of revolution at a small angle, the configuration of the sharply convex peripheral edge of the water engaging surface and the adjoining sidewall being such as to minimize surface tension induced suction on the stone, caused by the water across which the water engaging surface of the stone is moving;

the upper surface of the stone being generally flat so as to readily distinguish it from said lower, water engaging surface.

9. A skipping stone according to claim 8, wherein the stone is fabricated of a mixture of gypsum cement and fine sand in approximately equal parts by volume, the radius of the stone is a given dimension R, the average thickness is about 0.4R, the depth of the dimple in the near-center region of the stone water engaging surface is about 0.04R, the reduction in thickness in the convex near-edge region thereof at the peripheral edge is about 0.1R, and the angle of convergence of the sidewall is about 5°.

10. A skipping stone according to claim 9, wherein R equals about $\frac{7}{8}$th inch.

11. A skipping stone according to claim 9, wherein the near-center region of the stone water engaging surface extends from the center thereof outwardly about 45% of the radius of the stone.

* * * * *